United States Patent [19]

Thomas

[11] Patent Number: 4,865,560

[45] Date of Patent: Sep. 12, 1989

[54] APPARATUS FOR REMOVABLY CONNECTING FIRST AND SECOND MATABLE MEMBERS

[75] Inventor: Sherman G. Thomas, Earlysville, Va.

[73] Assignee: GE Fanuc Automation North America, Inc., Charlottesville, Va.

[21] Appl. No.: 153,630

[22] Filed: Feb. 8, 1988

[51] Int. Cl.[4] ..... H01R 13/621

[52] U.S. Cl. ..... 439/341; 439/362

[58] Field of Search ..... 439/359–365, 439/372, 338–341; 411/525, 527

[56] References Cited

U.S. PATENT DOCUMENTS

| | | | |
|---|---|---|---|
| 2,010,519 | 8/1935 | Jones | 411/527 |
| 2,135,417 | 11/1938 | Tinnerman | 411/527 |
| 2,259,425 | 10/1941 | Murphy | 411/527 |
| 2,542,404 | 2/1951 | Ensign | 439/372 |
| 3,617,985 | 11/1971 | Kehl | 439/341 |
| 3,764,957 | 10/1973 | Iversen | 439/362 |
| 3,984,169 | 10/1976 | Armstrong et al. | 439/341 |
| 4,738,632 | 4/1988 | Schmidt et al. | 439/341 |

*Primary Examiner*—Neil Abrams

*Attorney, Agent, or Firm*—Ormand R. Austin

[57] ABSTRACT

A connecting apparatus is provided for removably attaching a first member to a second member. The first and second members include respective mating surfaces which mate with each other. A pivot arm is situated adjacent one end of the mating surface of the first member. A jack screw is retained adjacent the remaining end of the mating surface of the first member. The jack screw includes a threaded end which extends from the mating surface of the first member and which faces the second member. The second member includes a pivot structure adjacent one end of the mating surface of the second member. The pivot structure of the second member permits the first member to pivot about the pivot structure when the pivot arm of the first member is removably engaged in the pivot structure. A screw captivating structure is situated in the second member for captively engaging the jack screw when the mating surface of the first member is pivoted toward and mated with the mating surface of the second member.

5 Claims, 2 Drawing Sheets

APPARATUS FOR REMOVABLY CONNECTING FIRST AND SECOND MATABLE MEMBERS

BACKGROUND OF THE INVENTION

This invention relates in general to apparatus for connecting two matable members and more particularly, to apparatus for tool-less assembly of a terminal board to a printed wiring assembly which accommodates forced separation of the member.

BRIEF SUMMARY OF THE INVENTION

It is often desirable for first and second matable parts to be connectable in a manner which holds the parts firmly together and yet permits such parts to be easily unmated when desired. For example, it is desirable for terminal boards to be connectable to printed wiring assembly (PWA) headers and to also be readily removable from such headers. Such a capability would permit replacement of the PWA without having to remove point-to-point wiring from the terminal board. Furthermore, the members should be connectable without the use of special tools in close environments, such as, for example, in PWA card racks. Removal of such PWA should also be facilitated by the connecting apparatus, i.e., the apparatus should aid in forcing the PWA from the card rack.

One object of the present invention is to provide an apparatus for connecting two matable members together in a manner such that the members are held together with substantial structural integrity and yet are relatively easily separated when unmating and unconnection are desired.

Another object of the present invention is to provide an apparatus for connecting two matable members together which requires no tools to mate and connect the two members.

In one embodiment of the invention, a connecting apparatus is provided for connecting a first member to a second member. The first member includes a first surface having first and second opposed ends. The first member further includes a pivot arm situated adjacent the first end of the first surface and extending away from the first member. A jack screw is retained in the first member at a location situated a predetermined distance from the pivot arm. The jack screw includes a head end which is retained within the first member and a threaded end extending away from the first surface thereof. The connecting apparatus further includes a second member having a second surface which is matable with the first surface of the first member. The second surface includes first and second ends. A pivot structure is situated adjacent one of the first and second ends of the second surface, for permitting the first member to pivot about the pivot structure when the pivot arm is removably engaged by the pivot structure. A jack screw captivating assembly is situated on said second member for captivating the threaded portion of the jack screw when the first surface is pivoted toward and mated with the second surface.

The features of the invention believed to be novel are specifically set forth in the appended claims. However, the invention itself, both as to its structure and method of operation, may best be understood by referring to the following description and the accompanying drawings.

DETAILED DESCRIPTION OF THE INVENTION

Figure 1:
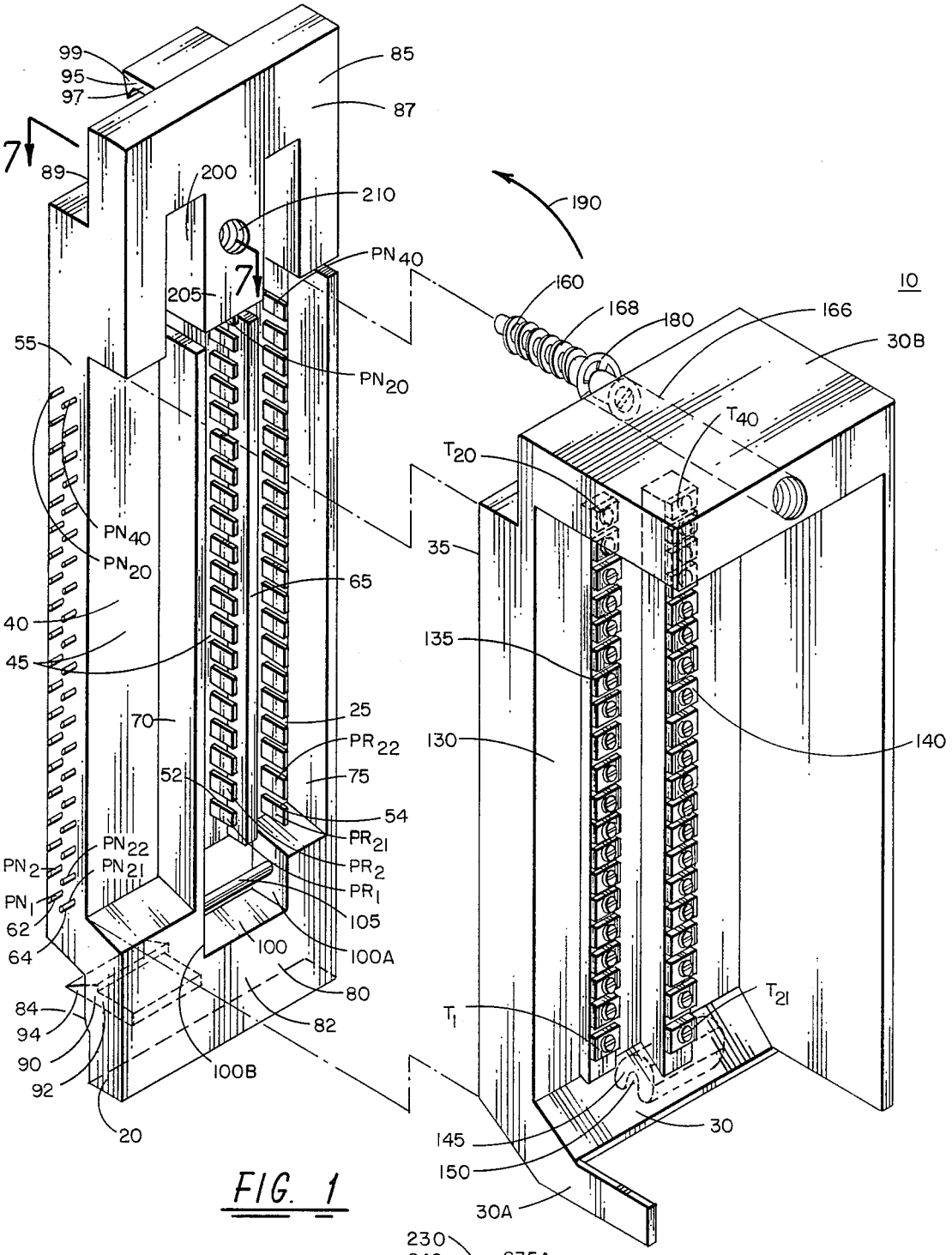
FIG. 1 shows a perspective view of the connecting apparatus of the present invention.

FIG. 1 is a front, top and left side perspective view of a connecting apparatus 10 in accordance with the present invention. Connecting apparatus 10 includes members 20 and 30 which are matable. In this particular embodiment of the invention, member 20 is illustrated as being a PWA header and member 30 is shown as a terminal board structure. Those skilled in the art will appreciate that the connecting apparatus of the invention is readily adapted to connect many matable structures together other than the PWA header and terminal board structures which are discussed here by way of example. Such alternative embodiments are intended to be within the scope of the present invention.

Figure 4:
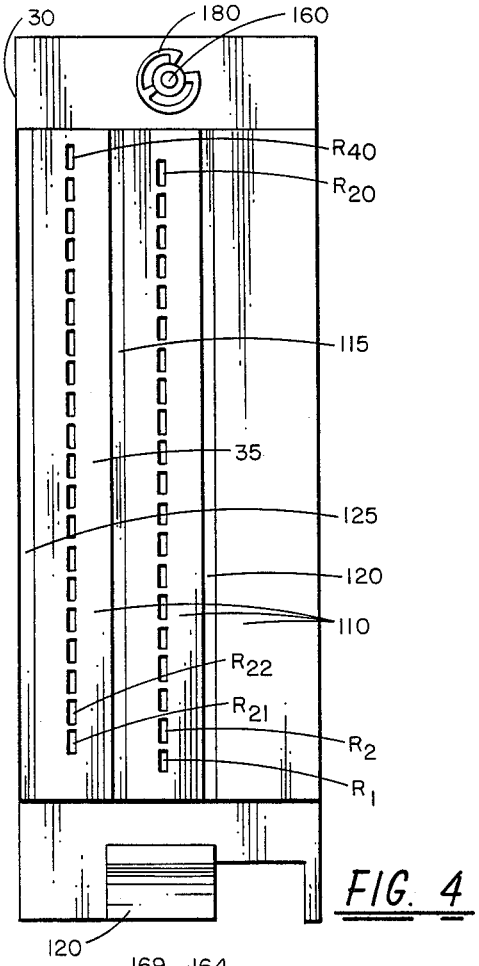
FIG. 4 is an elevational view of the back side of the second of two members which are connectable in accordance with the invention.

Members 20 and 30 respectively include matable portions 25 and 35 (only partially visible in FIG. 1 and more clearly seen in FIG. 4 which is discussed later). Member 20 further includes a main body 40 having a front surface 45. In this particular embodiment of the invention, matable portion 25 includes a plurality of male electrical connector prongs $PR_1$, $PR_2$ . . . $PR_{40}$ extending from front surface 45 as shown in FIG. 1. For convenience, prongs $PR_1$, $PR_2$ . . . $PR_{40}$ are arranged in rows 52 and 54. Row 52 includes prongs $PR_1$, $PR_2$ . . . $PR_{20}$. Row 54 includes prongs $PR_{21}$, $PR_{22}$ . . . $PR_{40}$. Main body 40 further includes a side surface 55 on which a plurality of electrical connector pins $PN_1$, $PN_2$ . . . $PN_{40}$ are situated. For convenience, pins $PN_1$, $PN_2$ . . . $PN_{40}$ are arranged in rows 62 and 64. Row 62 includes pins $PN_1$, $PN_2$ . . . $PN_{20}$. Row 64 includes pins $PN_{21}$, $PN_{22}$ . . . $PN_{40}$. Each of connector pins $PN_1$, $PN_2$ . . . $PN_{40}$ is electrically connected to a corresponding different one of prongs $PR_1$, $PR_2$ . . . $PR_{40}$, respectively. That is, in the embodiment shown, pin $PN_1$ is connected to prong $PR_1$, pin $PN_2$ is connected to prong $PR_2$,. . . and pin $PN_{40}$ is connected to prong $PR_{40}$. The actual electrical connections between each of pins $PN_1$, $PN_2$ . . . $PN_{40}$ to corresponding ones of prongs $PR_1$, $PR_2$ . . . $PR_{40}$ is accomplished by respective conductors (not shown) situated within main body 40. A PWA or other circuit board (not shown) is connectable to pins $PN_1$, $PN_2$ . . . $PN_{40}$.

Matable portion 25 includes a rib-like central guide member 65 disposed between rows 52 and 54 and extending from front surface 45. Matable portion 25 further includes rib-like guide members 70 and 75 extending from front surface 45 and disposed on either side of rows 52 and 54 as shown in FIG. 1.

Figure 2:
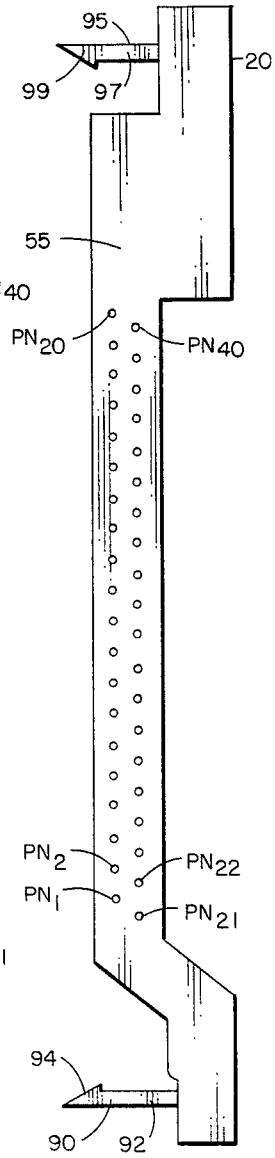
FIG. 2 is an elevational view of the left side of the first of two members which are connectable in accordance with the invention.

Member 20 includes a lower portion 80 and an upper portion 85 connected to the opposed ends of main body 40, respectively. Lower portion 80 and upper portion 85 include front surfaces 82 and 87, respectively. Lower portion 80 and upper portion 85 also include back surfaces 84 and 89, respectively. Latch members 90 and 95 are situated on back surfaces 84 and 89, respectively, such that member 20 may be attached to a mounting structure (not shown). Latch member 90 includes a bendable arm 92 which is attached at one end to back surface 84 of lower portion 80. A ramp-shaped catch 94 is connected to the remaining end of arm 92. Catch 94 engages a slot (not shown) in the aforementioned mounting structure to hold member 20 firmly to such mounting structure. Latch member 95 is substantially identical to latch member 90 and includes a bendable arm 97 and a rampshaped catch 99. Latch members 90 and 95 are more clearly illustrated in the left side elevational view of member 20 shown in FIG. 2 and also appear in the back side elevational view of member 20 shown in FIG. 3.

Figure 3:
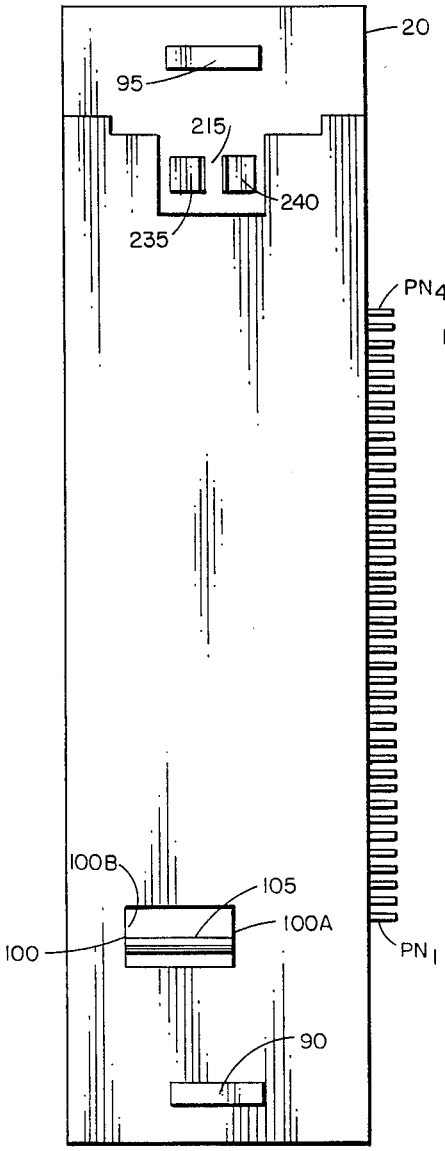
FIG. 3 is an elevational view the back side of the member of FIG. 2.

Considering FIG. 1 in conjunction with FIG. 3, it is seen that lower portion 80 includes a chamber 100 which opens onto front surface 82. Chamber 100 is bordered by opposed side walls 1OOA and 1OOB. A pivot bar 105 is centrally situated in chamber 100 and includes opposed ends which are mounted in side walls 1OOA and 1OOB, respectively. Thus, pivot bar 105 is laterally mounted with respect to side walls 1OOA and 1OOB of member 20.

As mentioned briefly above, member 30 includes a mating portion 35 which is shaped to mate with mating portion 25 of member 20. Mating portion 35 is shown more clearly in the back side elevational view of member 30 illustrated in FIG. 4 and in the left side elevational view of FIG. 5. More specifically, as seen in FIG. 4, mating portion 35 includes a back surface 110 which is shaped to mate with front surface 45 of mating portion 25. Back surface 110 of mating portion 35 includes channels 115, 120 and 125 which mate with guide members 65, 70 and 75, respectively, of mating portion 25.

Mating portion 35 of member 30 includes a plurality of female electrical receptacles $R_1$, $R_2$ . . . $R_{40}$ recessed into back surface 110 for mating with and electrically coupling to prongs $PR_1$, $PR_2$ . . . $PR_{40}$ of member 20. Member 35 includes a front surface 130 (see FIG. 1 momentarily) on which terminal strips 135 and 140 are disposed. Terminal strip 135 includes screw terminals $T_1$, $T_2$ . . . $T_{20}$. Terminal strip 140 includes screw terminals $T_{21}$, $T_{22}$ . . . $T_{40}$. Terminals $T_1$, $T_2$ . . . $T_{40}$ are electrically connected to receptacles $R_1$, $R_2$ . . . $R_{40}$, respectively, via a corresponding plurality of respective conductors (not shown) situated internal to member 30.

Figure 5:
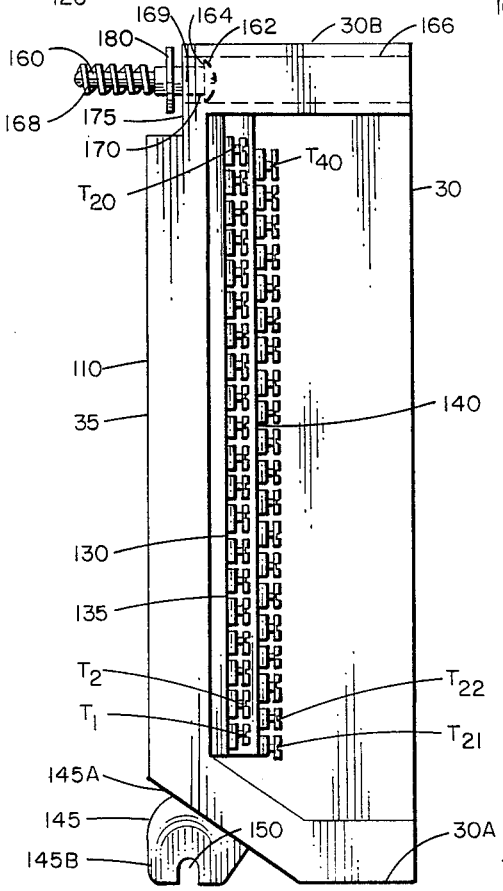
FIG. 5 is an elevational view of the left side of the member of FIG. 4.

As seen in FIG. 1 and more clearly in FIG. 5, a pivot arm 145 is situated extending from member 30 adjacent end 30A. Pivot arm 145 includes opposed ends 145A and 145B, of which end 145A is fixedly attached to back surface 110. The remaining end 145B includes a substantially U-shaped channel 150 which mates with pivot bar 105 when channel 150 is placed on pivot bar 105.

A jack screw 160 is situated at the opposite end 30B of member 30 as shown in FIG. 1 and FIG. 5. Jack screw 160 is located a predetermined distance away from pivot arm 145 as will be discussed in more detail subsequently. Since jack screw 160 is mounted internally to member 30, dashed lines are used to portray the internal mounting arrangement of jack screw 160 and associated structures seen in FIG. 5. Screw 160 includes a head 162 which rests at the bottom 164 of an aperture 166 having a diameter sufficiently large to accommodate head 162 therein. Screw 160 includes a threaded portion 168 and a shaft portion 169. Shaft portion 169 is situated in a substantially cylindrical hole 170 which extends between aperture bottom 164 and a screw mounting surface 175 adjacent end 30B.

Figure 6:
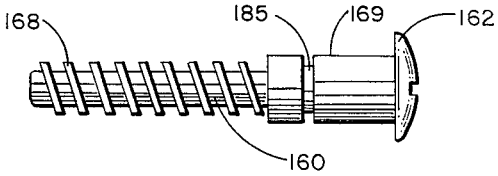
FIG. 6 is close-up representation of the jack screw employed in the member of FIGS. 4 and 5.

A retaining ring 180 is situated in a groove 185 (not visible in FIG. 5) around the circumference of the shaft portion 169 of screw 160. Referring momentarily to FIG. 6, a close-up view of jack screw 160 is shown which depicts the groove 185 referred to above. Returning again to FIG. 5, it is seen that retaining ring 180 prevents screw 160 from moving laterally in hole 170 and yet permits screw 160 to rotate freely within hole 170. One type of retaining ring which may be employed as retaining ring 180 is the "E-type" retaining ring shown in FIG. 4.

Referring again to FIG. 1, to use the connecting apparatus of the invention, end 30A of member 30 is removably attached to member 20 by placing channel 150 of member 30 on pivot bar 105 of member 20. End 30B of member 30 is then rotated or pivoted in the direction of arrow 190 toward upper portion 85 of member 20 until the threaded portion 168 of screw 160 of member 30 becomes captivated within member 20 as described subsequently.

Figure 7:
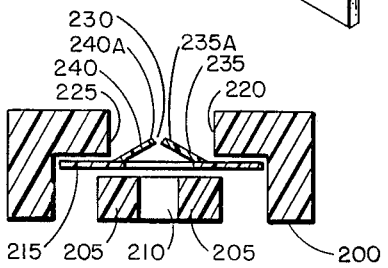
FIG. 7 is a cross section taken along the view 7—7 of FIG. 1.

Upper portion 85 of member 20 includes a jack screw captivating assembly 200. Assembly 200 includes a block 205 having a hole 210 for receiving the threaded portion 168 of screw 160 therein. A cross section of member 20 is taken along section line 7—7, of FIG. 1 to show screw captivating assembly 200 in more detail as in FIG. 7. A spring plate 215 is situated within assembly 200 between block 205 and plate side supports 220 and 225. The spring plate may be a "TINNERMAN NUT" or similar device. Spring plate 215 includes a central opening 230 into which spring fingers 235 and 240 project. Spring fingers 235 and 240 include ends 235A and 240A which are positioned adjacent each other. Spring finger ends 235A and 240A are situated sufficiently close together to captivate threaded portion 168 of screw 160 therebetween when threaded portion 168 is inserted into hole 210 and beyond. Viewing FIG. 7 in conjunction with FIG. 1, it is seen that a "snap-in" type action is thus provided when member 30 is pivoted toward member 20 and becomes mated therewith. That is, threaded portion 168 "snaps in" between finger ends 235A and 240A and is captively held therebetween. More specifically, as member 30 and screw 160 are progressively pivoted closer and closer to member 20, threaded portion 168 proceeds further and further through fingers 235 and 240 until members 20 and 30 are fully mated and connected. As the threads of threaded portion 168 pass through fingers 235 and 240, a series of snap actions occur and thus the term "snapably engaged" describes the captivation of threaded portion 168 by fingers 235 and 240. Since fingers 235 and 240 extend away from hole 210, screw 160 desirably cannot be easily "snapably disengaged" or "snapped out" of spring plate 215 once captivated or "snapably engaged" thereby. Mating and connection of members 20 and 30 is thus achieved.

The unmating of members 20 and 30 is accomplished by jacking out member 30 from member 20 by rotating jack screw 160 in an appropriate direction. For example, in an embodiment wherein screw 160 is a right hand threaded screw, left hand rotation of screw 160 pushes member 30 away from spring plate 215 and member 20 to unmate and disconnect member 30 from member 20. This jacking out action causes member 30 to be pivoted away from member 20 in a direction opposite that indicated by arrow 190 until the threads of threaded portion 168 are no longer engaged by fingers 235 and 240 of screw captivating assembly 200. To complete the disconnection of member 30 from member 20, channel 150 on pivot arm 145 is removed from pivot bar 105. It is noted that the aforementioned predetermined distance between the location of jack screw 160 and pivot arm 145 on member 30 is sufficiently long to form a lever arm therebetween which permits screw 160 to be relatively easily jacked out of spring plate 215 when screw 160 is rotated in the appropriate direction.

The foregoing has described a connecting apparatus for connecting two matable members together in a manner such that the members are firmly held together and yet are relatively easily separated when unmating is desired. The connecting apparatus includes a "snap in-jack-out" capability. Moreover, the connecting apparatus conveniently requires no tools to connect the two members.

While only certain preferred features of the invention have been shown by way of illustration, many modifications and changes will occur to those skilled in the art. It is, therefore, to be understood that the present claims are intended to cover all such modifications and changes which fall within the true spirit of the invention.

I claim:

1. A connecting apparatus comprising:

a first member including:

a first surface having first and second opposed ends;

a pivot arm situated adjacent the first end of said first surface and extending away from said first member;

a jack screw retained in said first member at a location situated a predetermined distance from said pivot arm, said screw including a head end retained within said first member and a threaded end extending away from said first surface; and a second member including:

a second surface matable with the first surface of said first member and having first and second ends;

pivoting means, situated adjacent one of the first and second ends of said second surface, for permitting said first member to pivot about said pivoting means when said pivot arm is removably engaged by said pivoting means; and screw captivating means, situated on said second member, for captivating the threaded portion of said jack screw when said first surface is pivoted toward and mated with said second surface, said screw captivating means including a plate mounted within said second member, said plate including an aperture and opposed first and second spring fingers extending into said aperture for snapably captivating said screw when the threaded portion of said screw is pushed between said fingers as the first member is pivoted toward and mated with said second member.

2. The apparatus of claim 1 wherein said predetermined distance between said jack screw and said pivot bar is sufficiently long to form a lever arm therebetween which permits said screw to be jacked out of said screw captivating means when said screw is rotated in an appropriate direction thus disconnecting and unmating said first and second members.

3. A connecting apparatus for connecting a first member to a second member comprising:

a first member including a first surface having first and second opposed ends;

a pivot arm attached adjacent the first end of said first surface and extending away from said first member;

a jack screw retained in said first member at a location situated a predetermined distance from said pivot arm, said screw including a head end retained within said first member and a threaded end extending away from said first surface;

a second member including a second surface matable with the first surface of said first member and having first and second ends;

pivoting means, attached adjacent one of the first and second ends of said second surface, for permitting said first member to pivot about said pivoting means when said pivot arm is removably engaged by said pivoting means; and screw captivating means, situated on said second member, for captivating the threaded portion of said jack screw when said first surface is pivoted toward and mated with said second surface, said screw captivating means including a plate mounted within said second member, said plate including an aperture and opposed first and second spring fingers extending into said aperture for snapably captivating said screw when the threaded portion of said screw is pushed between said fingers as the first member is pivoted toward and mated with said second member.

4. A connecting apparatus for connecting a first member to a second member, said first member including a first surface having first and second opposed ends, and wherein said second member includes:

a second surface having first and second opposed ends;

a pivot structure, situated adjacent one of the first and second ends of said second surface;

a jack screw captivating device including first and second spring fingers adapted to removably captivate a jack screw when said jack screw is pushed between said fingers;

said first member including:

said first surface wherein said first surface is shaped to be matable with the second surface of said second member;

a pivot arm attached adjacent one of the first and second ends of said first surface and extending away from said first member; and a jack screw retained in said first member at a location situated a predetermined distance from said pivot arm, said screw including a head end retained within said member and a threaded end extending away from said first surface, said jack screw snapping into the fingers of said jack screw captivating device when said pivot arm engages said pivot structure and said first member is pivoted toward and mated with said second member.

5. The apparatus of claim 4 wherein said predetermined distance between said jack screw and said pivot arm is sufficiently long to form a lever arm therebetween which permits said screw to be jacked out of said screw captivating means when said screw is rotated in the appropriate direction thus disconnecting and unmating said first and second members.

* * * * *